US005478457A

United States Patent [19]

Catteeuw et al.

[11] Patent Number: 5,478,457

[45] Date of Patent: Dec. 26, 1995

[54] APPARATUS FOR THE CONTINUOUS ELECTROLYTIC TREATMENT OF WIRE-SHAPED OBJECTS

[76] Inventors: Mario Catteeuw, Albertstraat 25, B-8550 Zwevegem; Pierre Cosaert, Lode de Boningestraat 34, B-8500 Kortrijk, both of Belgium

[21] Appl. No.: 300,194

[22] Filed: Aug. 24, 1994

Related U.S. Application Data

[63] Continuation of Ser. No. 972,711, Nov. 6, 1992, abandoned, which is a continuation of Ser. No. 499,384, filed as PCT/EP89/01093, Sep. 21, 1989, abandoned.

[30] Foreign Application Priority Data

Oct. 6, 1988 [BE] Belgium ..... 8801152

[51] Int. Cl.[6] ..... C25D 7/06

[52] U.S. Cl. ..... 204/206; 204/286; 205/138

[58] Field of Search ..... 205/138, 139, 205/140, 141, 142; 204/206, 286

[56] References Cited

U.S. PATENT DOCUMENTS

| | | | |
|---|---|---|---|
| 2,075,331 | 3/1937 | Antisell | 204/11 |
| 2,229,423 | 1/1941 | Schneler | 204/206 |
| 2,708,181 | 5/1955 | Holmes et al. | 204/28 |
| 2,946,734 | 7/1960 | Roy et al. | 204/279 |
| 3,507,767 | 4/1970 | Stricker | 204/208 |
| 3,630,864 | 12/1971 | Nakamura et al. | 204/140.5 |
| 3,691,049 | 9/1972 | Eppensteiner et al. | 204/206 |
| 4,395,320 | 7/1983 | Kasashima et al. | 204/206 |

*Primary Examiner*—John Niebling
*Assistant Examiner*—William T. Leader
*Attorney, Agent, or Firm*—Cushman Darby & Cushman

[57] ABSTRACT

Apparatus for the continuous electrolytic treatment of wire-shaped objects comprising an electrolyte bath and means for conducting the objects predominantly horizontally through the bath past a succession of anodes and cathodes, wherein the objects follow a zigzag path of travel in sliding contact with the successive current-transmitting electrodes that are immersed in the electrolyte and connected to one and the same pole of a power source.

10 Claims, 2 Drawing Sheets

APPARATUS FOR THE CONTINUOUS ELECTROLYTIC TREATMENT OF WIRE-SHAPED OBJECTS

This is a continuation of application Ser. No. 07/972,711, filed on Nov. 6, 1992, now abandoned, which was a continuation of application Ser. No. 07/499,384 filed as PCT/EP89/01093, Sep. 21, 1989, now abandoned.

The invention relates to an apparatus for the continuous electrolytic treatment of wire-shaped objects such as e.g. filaments, yarns, cables or strip-shaped bands or ribbons. This treatment can be either a coating treatment or a pickling treatment.

The continuous electrolytic galvanizing of wire-shaped objects in a continuous apparatus whereby the wires are conducted nearly horizontally past a succession of cathodes and inert anodes is known from U.S. Pat. No. 2,695,169. The current-transmitting sliding-contact points of the cathodes are located just below the electrolyte bath surface. The anode plates are completely immersed in the electrolyte. This apparatus makes a relatively fast electrodeposition possible. However, this set-up of the cathodic supporting arms with downwardly extending contact fingers above the bath is rather cumbrous and not very practical. Indeed, this set-up hinders an easy accessibility of the upper bath surface. Moreover, in the course of time, salt crystals from the bath precipitate on the supporting arms and the cathode fingers above the bath, which entails frequent cleaning and maintenance. Besides, the requirement of an even and constant sliding contact between the cathode fingers and the wires is hard to fulfil. The cathode fingers have as it were the tendency to vibrate or dance up and down on the wires as a result of which there are frequent contact interruptions which result in sparking and consequently in an irregular deposition quality.

The object of the invention is now to to overcome these drawbacks by immersing the supporting and current-carrying arms of the successive cathodes in the electrolyte. This precludes the formation of salt crystals and the maintenance that it entails. Besides, this set-up has the added advantage that the immersed cathode can cool down more easily. Indeed, as the wires have a relatively high running speed through the installation, high current densities are to be used which can cause the cathodes to heat up considerably. Cooling in liquid and circulating electrolyte is much more effective than air cooling such as for contact fingers or contact rollers placed above the bath or at the bath entry and exit, respectively. The accessibility of the bath surface that is markedly improved in accordance with the invention is particularly advantageous upon starting the apparatus when a new series of wires is to be pulled through from entry (pay-off) to exit (take-up unit). It also improves the surveyability of the installation, which makes process control easier for the operator.

It is therefore an object of the invention to provide an apparatus for the continuous electrolytic treatment of wire-shaped objects, the latter being conducted predominantly horizontally via suitable transport means through an electrolyte bath past a succession of anodes and cathodes. In the apparatus, the objects follow a zigzag path of travel in sliding contact with the successive current-transmitting electrodes connected to one and the same pole of the power source. The electrodes, i.e. their parts assuring the sliding-contact, and the elements supporting them are immersed in the electrolyte bath.

In addition to the aforementioned advantages, the application of the zigzag path of travel over the sliding contacts of said electrodes precludes the tendency of sparking which occurs with state-of-the-art electrode fingers. Indeed, the considerable transport tension on the wires between pay-off and take-up unit guarantees a constant and even contact of the wire with the electrodes at the peaks and valleys of the zigzag path of travel. It follows that operational reliability and the assurance of a constant process quality are obtained via a strong simplification of the prior art apparatuses.

If the treatment apparatus is an electroplating line, said electrodes with sliding contacts will be connected as cathodes. The wires conducted against the sliding contacts then constitute the cathode in the coating line and the positive ions of the metal (e.g. zinc) to be applied will precipitate on them from the electrolyte in the path of travel at the anodes located opposite the wires.

For a treatment apparatus in the form of a pickling apparatus, said electrodes will be connected as anodes. The metal coating to be removed from the passing wires then dissolves in the electrolyte and deposits on the stationary cathodes at the path of travel of the wire near these cathodes.

A coating apparatus as embodiment of the invention will hereinafter be illustrated with reference to the accompanying figures.

Figure 1:
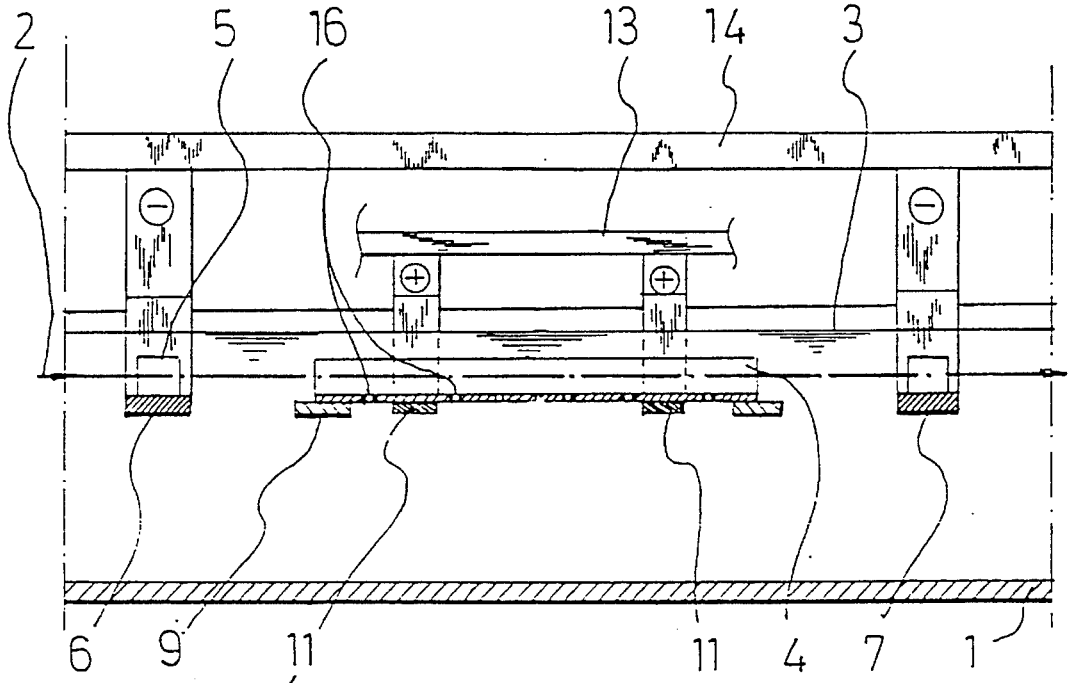
FIG. 1 is a vertical section through the set-up of successive electrodes in the electrolyte bath of the coating line.

The electrolysis apparatus in accordance with FIG. 1 basically comprises an elongate tank or channel 1 as electrolyte bath. This bath 1 is filled with a suitable electrolyte up to level 3 so that both the anodes 4 and the cathodes 5 are immersed in it. The cathode pins 5 are fixed on successive supporting arms 6, 7, 8 (e.g. of copper). The successive anode sections 9, 10 are mounted between said supporting arms. Said sections comprise the supporting arms 11 (e.g. of copper) for the anode plates 4, 12. These are e.g. inert lead anodes. The respective supporting arms for cathodes and anodes are connected to the current-supply bars 13 and 14. The electrode-supporting parts (6, 7, 8) of these arms are immersed with the electrodes 5 in bath 1 under the bath surface 3.

In order to realize a good electrolysis efficiency, the electrolyte can be continuously circulated by means of pumps (not shown) and through the bores 16 in the anode plates towards the surface level 3 of the bath 1. The circulation increases the turbulence in the bath, which increases the electrolysis efficiency.

Figure 2:
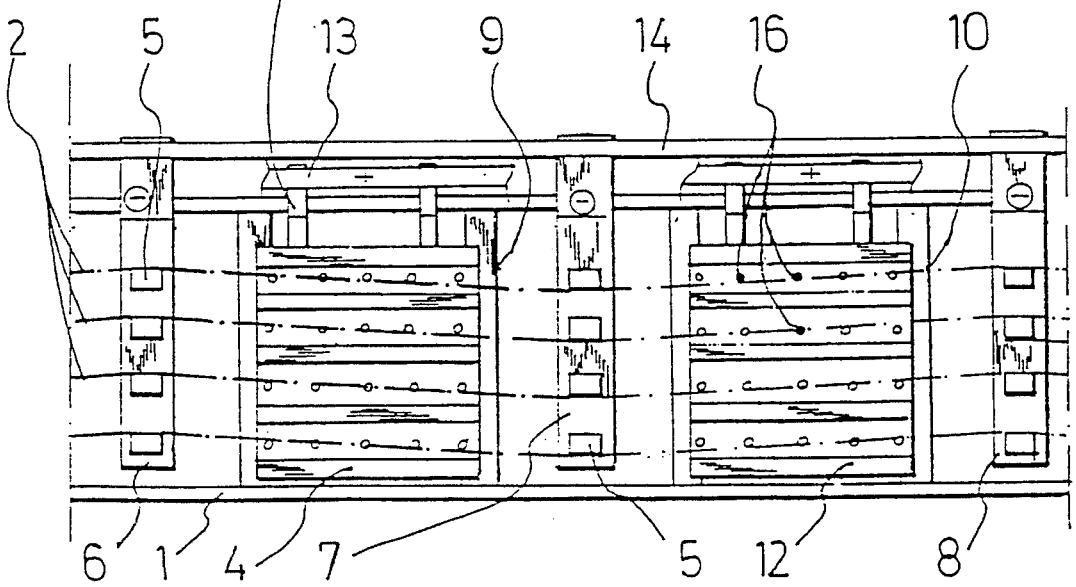
FIG. 2 represents a view from above of the apparatus with a zigzag path of travel for the series of wires.

The wire-shaped objects 2 to be coated are now continuously conducted past a succession of anodes 4, 12 and cathode supports 6, 7, 8 below the electrolyte surface 3. In the process, the wires drag against the pins 5 fixed on the respective current-carrying supporting arms 6, 7, 8 as a result of which they are connected as cathode, tracing a horizontal zigzag path of travel as shown in FIG. 2. So, the successive peaks and valleys of the zigzag path of travel are located at these pins 5. The electrodes themselves comprise a highly conductive but preferably also wear-resistant metal alloy, e.g. tungsten carbide at the sliding contacts at the zigzag peak/valley positions.

Figure 3:
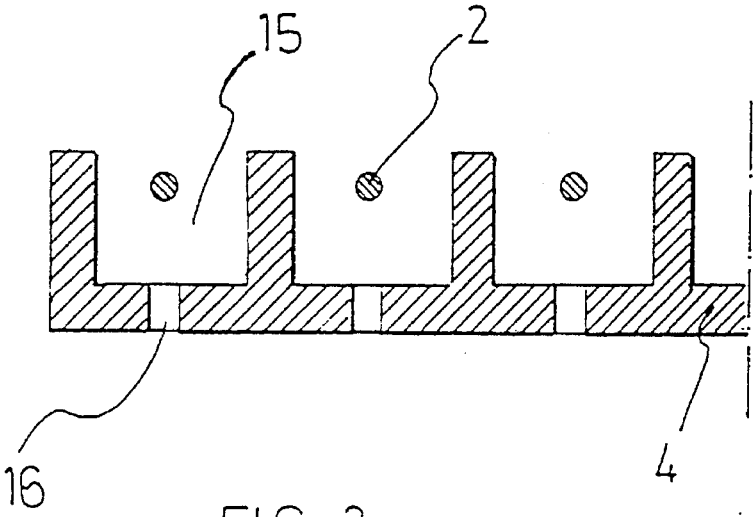
FIG. 3 is a cross-section through an inert anode plate of the apparatus as electroplating line.

In each space between two consecutive peak/valley positions, the wires come in the vicinity of the inert anode plates 4, 12 where the desired metal deposition from the bath 1 takes place. The anode plates 4, 12 can be designed flat but will preferably comprise channel-shaped recesses 15 (as sketched in FIG. 3) at the path of travel of the wires 2 between two consecutive cathode pins 5. This way, a more even metal deposition is obtained over the whole wire circumference.

Figure 4:
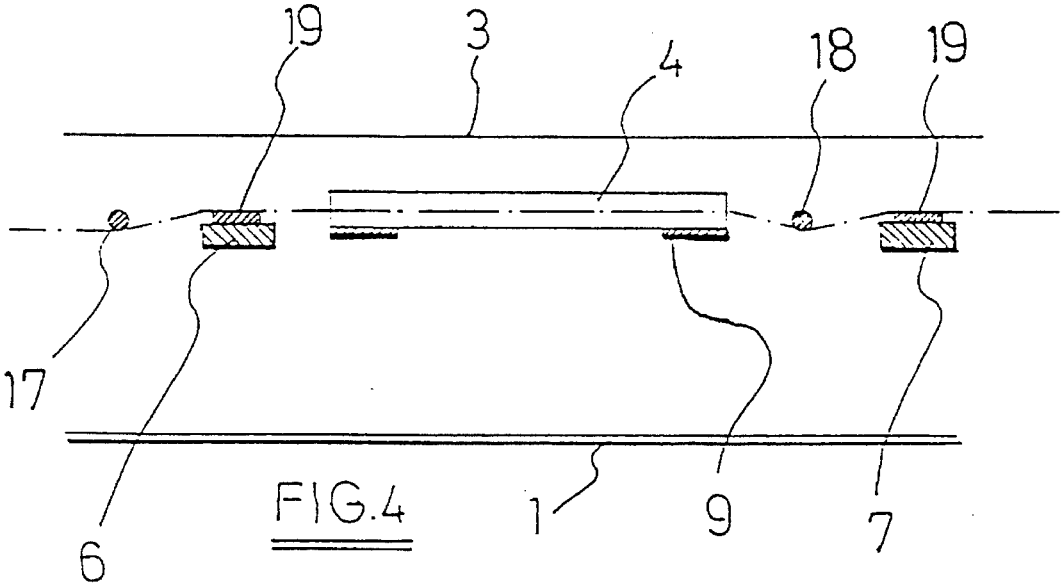
FIG. 4 shows a vertical section through another electrode set-up for a zigzag path of travel.

FIG. 4 schematically shows another nearly horizontal zigzag path of travel for the wires 2. An insulated (ceramic) counterpressure bar 17 or 18 is mounted near each cathode-supporting arm 6 or 7 respectively. These can e.g. be tilted upwards out of and away from the bath for the purpose of making the bath surface easily accessible when starting the apparatus for a new series of wires. The cathode-supporting arms 6, 7 are each coated with a wear-resistant layer 19 as sliding contact for the transmission of current to the wires.

We claim:

1. Apparatus for the continuous electrolytic treatment of wire-shaped objects, said apparatus comprising:

an elongate tank enclosing an electrolyte bath with the bath having a surface, means for moving at least one object in a treatment direction through said bath past a succession of electrodes, first and second and third adjacent support structures each including a vertical member and a substantially horizontal portion attached to said vertical member and oriented in a direction generally transverse to the direction of travel of said at least one object being treated and disposed generally parallel to said surface, said horizontal portion of each of said first and third support structures including at least one current transmitting electrode arranged to contact said at least one object, each of said horizontal portions being immersed in said electrolyte bath, so that each said horizontal portion and said at least one current transmitting electrode thereon lie completely beneath the surface of said electrolyte bath, said second support structure, positioned between said first and third support structures, having a counter electrode on said horizontal portion, wherein the said at least one object follows a path of travel vertically open to said surface in sliding contact with said current transmitting electrodes, said current transmitting electrodes being connected to a common pole of a power source.

2. Electrolytic treatment apparatus in accordance with claim 1 wherein said current transmitting electrodes are connected as cathodes, for electroplating.

3. Electrolytic treatment apparatus in accordance with claim 1, wherein said current transmitting electrodes are connected as anodes, for pickling.

4. Electrolytic treatment apparatus in accordance with claim 1, wherein said current transmitting electrodes comprise a wear-resistant metal alloy at the sliding contacts.

5. Electrolytic treatment apparatus in accordance with claim 4, wherein each of said current transmitting electrodes comprises a sliding-contact pin fixed on said horizontal portion.

6. Electrolytic treatment apparatus in accordance with claim 5, wherein said counter electrode are inert.

7. Electrolytic treatment apparatus in accordance with claim 1, wherein said current transmitting electrodes are constructed and arranged so that said path of travel is a zig-zag path of travel.

8. Electrolytic treatment apparatus in accordance with claim 1, wherein said counter electrode comprises a plurality of channel-shaped recesses through which said at least one object is moved.

9. Apparatus for the continuous electrolytic treatment of wire-shaped objects, said apparatus comprising:

a tank adapted to enclose an electrolyte bath, means for moving at least one object in a treatment direction through the tank, at least two current transmitting electrode support structures each comprised of a vertical member, a generally horizontal member extending from said vertical member and at least one upwardly extending current transmitting electrode disposed on a top surface of each of said horizontal members, said current transmitting electrodes being constructed and arranged to be vertically open and contacted by said at least one object being treated, at least one intermediate counter electrode support structure comprised of at least one vertical support, a generally horizontal support extending from said vertical support and at least one counter electrode supported by said horizontal support, said horizontal members and said current transmitting electrodes, said horizontal support and said counter electrode each being constructed and arranged with respect to said tank so that each is completely submerged in a bath contained in said tank during treatment of said at least one object, said current transmitting electrodes being connected to a common pole of a power source.

10. Electrolytic treatment apparatus in accordance with claim 9, wherein said horizontal member and said horizontal support each extend across said tank in a direction oriented generally transverse to the direction of the objects being treated.

* * * * *